US005224918A

United States Patent [19]

Neumann et al.

[11] Patent Number: 5,224,918

[45] Date of Patent: Jul. 6, 1993

[54] METHOD OF MANUFACTURING METAL CONNECTOR BLOCKS

[75] Inventors: Eugene F. Neumann; Melvin C. August, both of Chippewa Falls; Daniel C. Mansur, Jim Falls; Richard J. Kelley, Elk Mound, all of Wis.

[73] Assignee: Cray Research, Inc., Eagan, Minn.

[21] Appl. No.: 963,813

[22] Filed: Oct. 20, 1992

Related U.S. Application Data

[62] Division of Ser. No. 722,110, Jun. 27, 1991, Pat. No. 5,178,549.

[51] Int. Cl.[5] ..... H01R 43/00

[52] U.S. Cl. ..... 29/885; 29/830; 361/386; 361/412; 439/59; 439/74

[58] Field of Search ..... 29/830, 852, 845, 885; 156/901; 361/386, 412; 439/59, 74

[56] References Cited

U.S. PATENT DOCUMENTS

| | | |
|---|---|---|
| 2,163,412 | 6/1939 | Schneider . |
| 2,694,799 | 11/1954 | Del Camp . |
| 2,969,521 | 1/1961 | Scoville . |
| 3,022,480 | 2/1962 | Tiffany . |
| 3,097,032 | 7/1963 | Hochheiser . |
| 3,212,049 | 10/1965 | Mittler et al. . |
| 3,333,225 | 7/1967 | McNutt . |
| 3,459,998 | 8/1969 | Focarile . |
| 3,568,001 | 3/1971 | Straus . |
| 3,670,409 | 6/1972 | Reimer . |
| 3,744,128 | 7/1973 | Fisher et al. . |
| 3,757,276 | 9/1973 | Kailus . |
| 3,832,603 | 8/1974 | Cray et al. . |
| 3,851,221 | 11/1974 | Beaulieu et al. . |
| 3,876,822 | 4/1975 | Davy et al. . |
| 3,904,934 | 9/1975 | Martin . |
| 3,958,851 | 5/1976 | Evans . |
| 3,999,830 | 12/1976 | Herrmann, Jr. et al. . |
| 4,054,939 | 10/1977 | Ammon . |
| 4,208,080 | 6/1980 | Teagno . |
| 4,240,198 | 12/1980 | Alonso . |
| 4,283,754 | 8/1981 | Parks . |
| 4,295,184 | 10/1981 | Roberts . |
| 4,352,533 | 10/1982 | Murase et al. . |
| 4,468,076 | 8/1984 | Hine et al. . |
| 4,505,532 | 3/1985 | Hine et al. . |
| 4,514,784 | 4/1985 | Williams et al. . |
| 4,574,236 | 3/1986 | Hechtman . |
| 4,700,996 | 10/1987 | August et al. . |
| 4,712,849 | 12/1987 | Seidel et al. . |
| 4,720,770 | 1/1988 | Jameson . |
| 4,724,180 | 2/1988 | Kern . |
| 4,734,046 | 3/1988 | McAllister et al. . |
| 4,734,058 | 3/1988 | Pavlacka . |
| 4,797,113 | 1/1989 | Lambert . |
| 4,806,111 | 2/1989 | Nishi et al. . |
| 4,813,128 | 3/1989 | Massopust . |
| 4,884,168 | 11/1989 | August et al. . |
| 4,906,194 | 3/1990 | Grabbe . |
| 4,911,645 | 3/1990 | August et al. . |
| 4,961,709 | 10/1990 | Noschese . |
| 5,014,419 | 5/1991 | Cray et al. ..... 29/830 |
| 5,037,332 | 8/1991 | Wilson . |
| 5,045,975 | 9/1991 | Cray et al. ..... 29/830 X |
| 5,098,305 | 3/1992 | Krajewski et al. ..... 29/830 X |

FOREIGN PATENT DOCUMENTS

| | | |
|---|---|---|
| 0039175 | 11/1981 | European Pat. Off. . |
| 0243021 | 10/1987 | European Pat. Off. . |
| 0402791 | 12/1990 | European Pat. Off. . |

OTHER PUBLICATIONS

IBM® Technical Disclosure Bulletin, entitled "Shielded Connectors", vol. 22, No. 2, dated Jul. 1979, pp. 523-524.

Article entitled "Connector Interposer for Module to Board Connection", Martyak, Natoli, and Ricci; IBM Technical Disclosure Bulletin, vol. 14, No. 8, dated Jan. 1972, p. 2297.

*Primary Examiner*—Carl J. Arbes

*Attorney, Agent, or Firm*—Merchant, Gould, Smith, Edell, Welter & Schmidt

[57] ABSTRACT

A completely shielded metallic connector block for use in multiple circuit modules of an electronic device. Electrical communication between the circuit boards is effected by an array of metallic pins which run through the blocks. The metal of the blocks can be held at ground or at a constant potential to increase the shielding between pins as well as maintaining voltage and ground planes at constant levels throughout the modules. The blocks are insulated from the pins and circuit boards by a non-conductive coating. In the preferred embodiment, the metal of the blocks is aluminum and the coating is a hardcoat anodizing.

17 Claims, 9 Drawing Sheets

FIG. 2
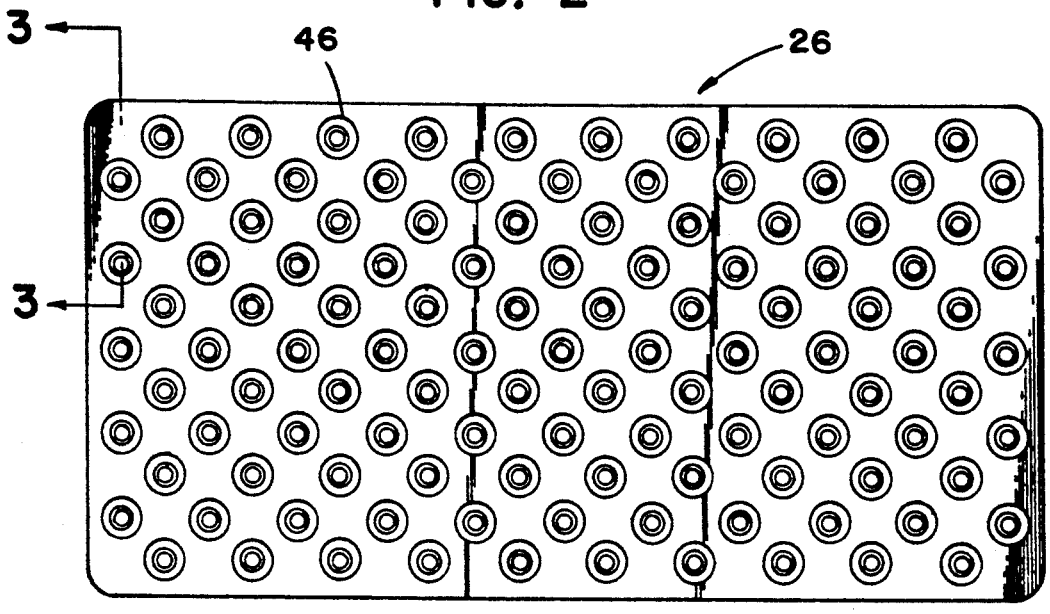
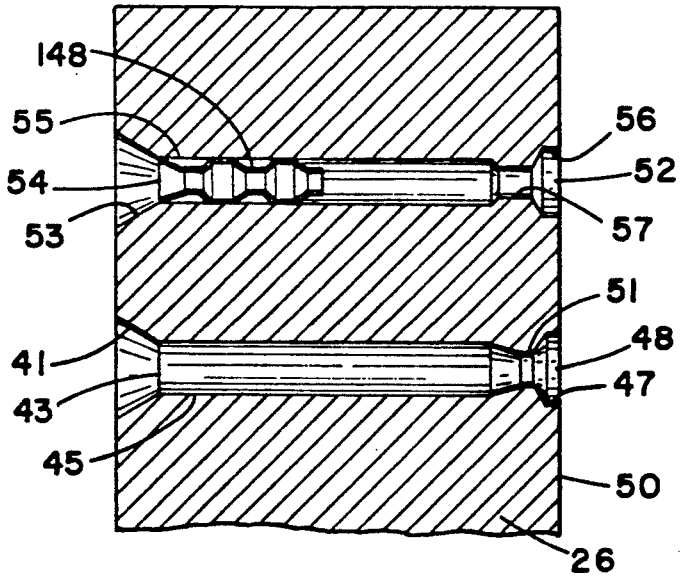
FIG. 3

FIG. 4
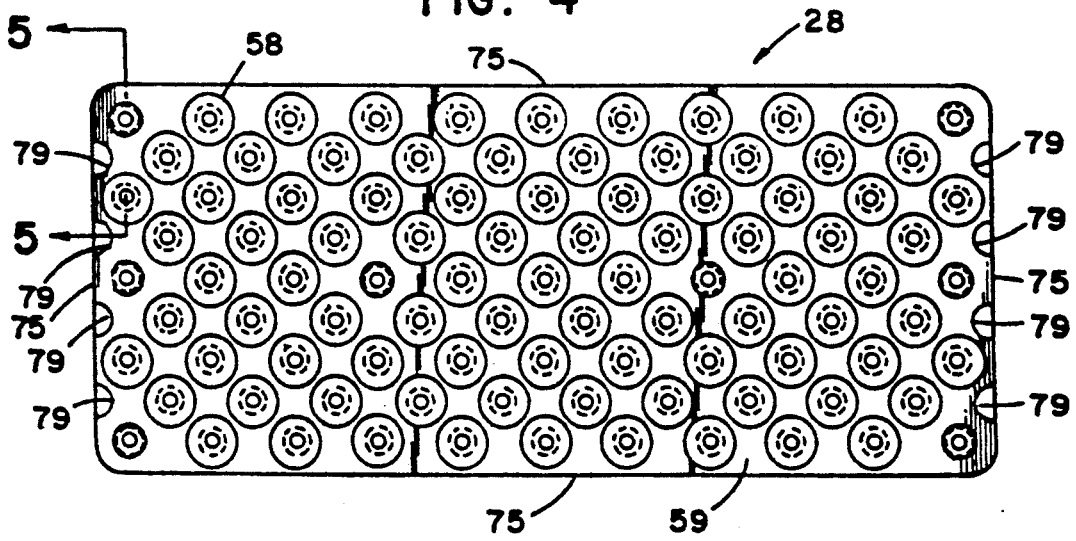
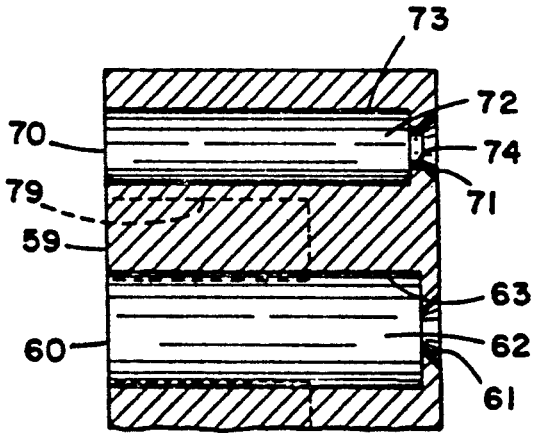
FIG. 5

METHOD OF MANUFACTURING METAL CONNECTOR BLOCKS

This is a division of application Ser. No. 07/722,110, filed Jun. 27, 1991 now U.S. Pat. No. 5,178,549 issued Jan. 12, 1993.

BACKGROUND OF THE INVENTION

1. Field of the Invention

The present invention relates to connector blocks used in the multiple circuit modules of electronic devices such as high-speed digital computers of the type produced by Cray Research, the assignee hereof. Specifically, the present invention relates to shielded metallic connector blocks for multiple circuit modules which provide completely shielded connector paths between circuit boards.

2. Description of the Prior Art

Circuit boards are utilized in many types of electronic equipment and it is often necessary, particularly in complex equipment, to interconnect the circuit boards into a module, and to interconnect modules into multiple circuit modules. For example, some high-speed electronic digital computers of the type produced by Cray Research utilize circuit modules consisting of four circuit boards mounted in close proximity on opposite sides of two cooling plates. Such circuit modules are arranged in banks and it is, therefore, desirable to interconnect adjacent circuit boards within a module in a manner which permits convenient disconnection for service and reconnection after service, and which also permits reversed stacking for testing.

One previously known example of an interconnected multiple circuit module is disclosed in U.S. Pat. No. 4,514,784 to Williams et al. In this apparatus, conductive pins are used to transmit signals from one circuit module to another. Electrical connection between the pins is accomplished by connector blocks positioned between the modules having bores defined therein for receiving the pins. This type of module connection was a great improvement over previous designs because it minimized twisting and misalignment of the connector elements, while facilitating connection over the shortest circuit paths.

However, as the architecture of high-speed electronic digital computers evolves, greater switching speed and circuit density are required. As circuit density increases, a greater number of connections are necessary between modules, thereby increasing the total force needed to connect the modules.

In response to that need, U.S. Pat. No. 4,939,624 to August et al. disclosed an improved interconnected circuit module using connector blocks both between modules and circuit boards within the modules to decrease the total force needed to connect modules while providing an increased number of connections.

As a result of the increased number of connections in the limited space, it became increasingly likely that transmission of a signal through a first circuit path would possibly affect the operation of an adjacent path. This phenomenon is known as cross-talk, and is a major impediment to improved circuit density in high-speed digital computers. The cross-talk problem has two components, capacitive cross-talk and inductive cross-talk. U.S. Pat. No. 4,939,624 attempted to solve that problem by incorporating additional shielding elements in or on the blocks. Such an approach, however, effectively dealt only with capacitive cross-talk and failed with respect to inductive cross-talk. In addition, it added significantly to the cost and complexity of the connector blocks.

It is clear that there has existed an unfilled need for improved connector blocks for use in interconnected multiple circuit modules which reduce the aggregate force necessary for assembly and disassembly while providing adequate shielding to reduce inductive interference between adjacent circuit paths.

SUMMARY OF THE INVENTION

Accordingly, it is an object of the present invention to provide improved connector blocks for use in connecting both circuit boards and modules of circuit boards which offers increased shielding between adjacent signal paths through the connector blocks.

To accomplish that objective, the present invention comprises a connector block apparatus which provides essentially completely shielded operation of adjacent circuit paths due to the electrically conductive nature of the metallic block which can be held either at ground or at a constant potential to prevent induction between signal paths. The advantages of the present invention are available because of the novel use of nonconductive coatings and bushings allows the blocks to selectively pass electrical signals without shorting the signal in the conductive block.

In the preferred embodiment, the block is constructed of 6061-T6 aluminum and the nonconductive coating is a hardcoat anodized finish, which coats the exterior of the block as well as the interior of any holes formed in the block prior to anodizing.

In addition to providing a nonconductive finish, the hardcoat anodizing of the preferred embodiment provides a mask to allow electrolytic zincate/copper/gold plating of areas on or in holes in the block which are not covered by the hardcoat anodizing. The plated areas provide increased electrical conduction between the block and conductive objects brought into contact with the plated areas. In the preferred method, constant potential holes are formed in the block after anodizing to allow such electrolytic coating of their interior surfaces.

The present invention also offers the advantages of flexibility in the placement of constant potential holes relative to the signal holes formed in the block. That flexibility allows the designer the ability to tailor the shielding to the needs of the signals transmitted through the blocks. In addition, the hole dimensions and objects placed in the holes can be chosen to provide an impedance value desired for the given system.

A multiple circuit module using the present invention includes a plurality of circuit boards arranged in facing pairs, each circuit board having a plurality of pin receiving recesses defined therein; a plurality of cold plates positioned between the circuit boards in each of the facing pairs, respectively, for conducting waste heat away from the circuit boards, each cold plate having an open space defined therein for allowing electronic communication between the circuit boards; a plurality of shield connector blocks positioned within the open spaces, respectively, each having a plurality of through-holes defined therein; at least one dual-entry connector block interposed between two of the circuit board pairs, the connector block having a plurality of connector through-holes defined therein; a plurality of electrically conductive signal pins for conducting electrical signals from one of the circuit board pairs to another of the circuit board pairs, the signal pins being selectively insertable in the pin receiving recesses, the through-bores or the connector bores, depending on the desired path of the signals.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there are illustrated and described preferred embodiments of the invention.

BRIEF DESCRIPTION OF THE DRAWINGS

FIG. 2 is a top plan view of a shield connector block according to the embodiment of FIG. 1;

FIG. 3 is a cross-sectional view taken along lines 3—3 in FIG. 2;

FIG. 4 is a top view of the dual-entry connector block in the embodiment of FIG. 1;

FIG. 5 is a cross-sectional view taken along lines 5—5 in FIG. 4;

DETAILED DESCRIPTION OF THE PREFERRED EMBODIMENT(S)

Figure 1:
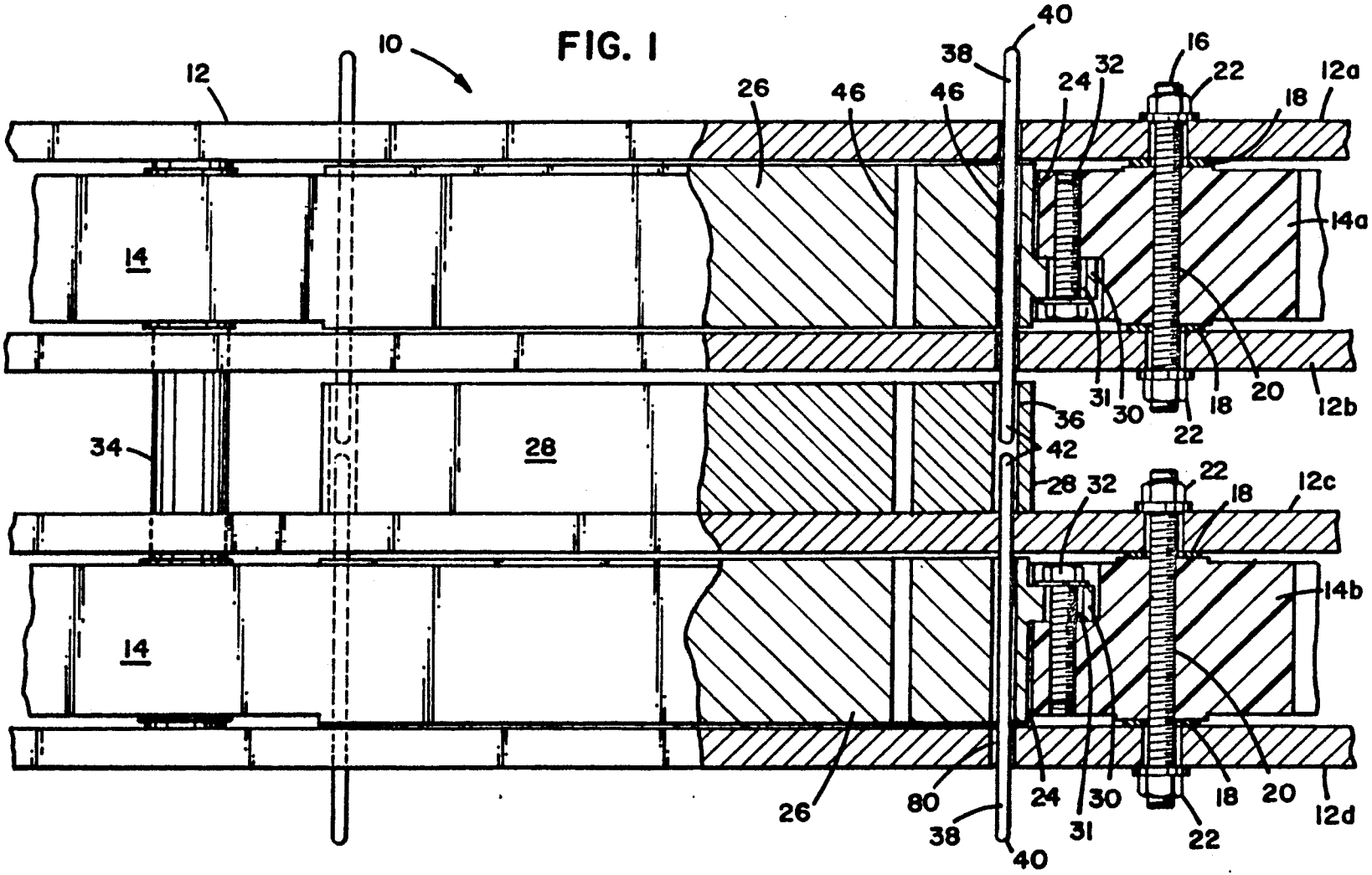
FIG. 1 is a side cutaway view, taken partially in cross-section, of a circuit board module constructed using the connector blocks of the present invention.

Referring now to the drawings, wherein like reference numerals designate corresponding elements throughout the views, and particularly referring to FIGS. 1–6, there is shown an interconnected multiple circuit module 10 utilizing both shield connector blocks 26 and dual-entry connector blocks 28 according to the preferred embodiments of the invention. As is best illustrated in FIG. 1, circuit module 10 includes a plurality of planar circuit boards 12*a* through 12*d*, generally referred to as 12, which are arranged to extend in a parallel, spaced relationship. In order to maintain the circuit boards 12 at a proper operating temperature, pairs of circuit boards 12*a*, 12*b* and 12*c*, 12*d* are disposed about cold plates 14*a* and 14*b* respectively, generally referred to as 14. Cold plates 14 conduct excess heat energy away from the circuit boards as described in U.S. Pat. No. 4,628,407 and as described in U.S. patent application Ser. No. 07/284,992, entitled "Cold Plate With Interboard Connector Apertures for Circuit Board Assemblies", filed on Dec. 14, 1988 and assigned to the assignee of the present patent application. The two pairs of circuit boards 12 disposed about two cooling plates 14 form a single module. Each pair of circuit boards 12 is secured to cold plate 14 by a spacer/connector assembly 16 which includes a pair of spacers 18 disposed between the circuit boards 12 and cold plate 14, a threaded stud 20 and a pair of fastening nuts 22, as is shown in FIG. 1.

In order to permit communication between circuitry on the various circuit boards 12, a number of open spaces are defined by surfaces 24 on each of the cold plates 14, as is shown in FIG. 1. Each of the spaces defined by surfaces 24 extend through the entire width of the corresponding cold plate 14 and contains a shield connector block 26. Each of the shield connector blocks 26 is provided with an array of through-bores or holes 46 defined therein which may be coincident with pin receiving recesses or bores defined in the attached circuit boards 12. The shield connector blocks 26 may be manufactured with a predefined array of holes such that all the holes may not be used in a particular application. In the preferred embodiment, the shield connector blocks 26 are constructed of 6061-T6 aluminum and are hardcoat anodized to minimize cross-talk between adjacent pins (as described in further detail below). Other materials could be substituted in place of the aluminum and hardcoat anodizing. The only limits on the alternate materials being that the metals should be non-magnetic and the outermost coating must electrically insulate the blocks, including the interior of the holes in a substantially uniform manner.

In order to provide electronic signal, voltage and ground communication between the various circuit boards 12, a plurality of conductive pin members 38 extend through the recesses provided in circuit boards 12 and through the bores 46 in the connector blocks 26. Pins 38 may be electrically connected to circuitry on each of the various circuit boards 12 by removable connectors, by soldering, or such connection may be effected by plating the surfaces defining the pin receiving recesses or holes on circuit boards 12.

In the preferred embodiment, removable connectors 146 are used in the circuit boards 12 and in at least some of the bores 46 in the connector blocks 26. The preferred connectors 146 are Zierick sockets manufactured by the Zierick Company, Radio Circle Drive, Mount Kisco, N.Y. 10549.

A complete circuit module is formed of two pairs of circuit boards 12*a*–12*d*, each pair being sandwiched between a cold plate 14*a* and 14*b*. In cross-section, a half circuit module is formed of a single pair of circuit boards 12, a single cold plate 14 and a shield connector block 26. In order to interconnect two half modules, pins 38 may be provided with first and second end portions 40, 42, respectively, the second ends 42 of which extend outwardly beyond the surfaces of circuit boards 12*b* and 12*c* and have preferred diameters of 0.018" while the remainder of the pins 38 have preferred diameters of 0.012".

As shown in FIG. 1, a dual-entry connector block 28 is freely disposed between a pair of such half modules and has an array of connector through-holes 58 defined therein for receiving end portions 42 of the connector pins 58. For example, as shown in FIG. 1, connector hole 58 receives the second end portion 42 of pin 38 from the upper half module and a corresponding pin end portion from the lower half module so as to electrically connect the two pins 38 by means of a dual entry contact or other suitable means (not shown in FIG. 1, but described in more detail below in conjunction with FIG. 6). The two half modules are secured together by suitable means and spaced apart by means of spacer 34 controlling the amount of space and gaps between the upper and lower half modules.

The shield connector blocks 26 and dual-entry connector blocks 28 may be manufactured with a predefined array of holes such that all the holes may not be used in a particular placement on the circuit module. In the preferred embodiment, the blocks are constructed of 6061-T6 aluminum and are hardcoat anodized to minimize cross-talk between adjacent pins (as described in further detail below). Other materials could be substituted in place of the aluminum and hardcoat anodizing. The only limits on the alternate materials being that the metals should be non-magnetic and the outermost coating must electrically insulate the blocks, including the interior of the holes, in a substantially uniform manner.

Ground and voltage connections between circuit boards in a module are typically made between edge connectors and backplanes to supply voltages and ground current return paths for the operating logical circuits located on circuit boards 12. Electrical signals propagating between circuit boards 12*a*–12*d* require that a signal path be established from one board to another and a voltage or ground current return path also exists for the requisite current to flow. Traditionally, the current return paths between circuit boards in a module are supplied through the backplane connections. If, however, the current return paths are electrically stressed in that they are supplying current to a large number of switching circuits simultaneously, the voltage and ground current return paths between remote signal source and signal destination points may experience a shift in overall potential, causing slow gate switching, changing voltage switch thresholds, and lowering of noise margins. To avoid these problems, constant potential openings in the shield and dual-entry blocks provide additional voltage and ground current return paths between circuit boards 12 to further lower the inductance between the voltage and ground return paths between the circuit boards. Thus, the blocks further serve to maintain all the voltage and ground planes on circuit boards 12 at the same relative potential in module 10.

An additional advantage of the blocks of the preferred invention is the flexibility allowed in placing the constant potential openings in the blocks for optimal shielding and ground plane maintenance in the half modules and full modules.

In addition to maintaining the voltage and ground planes, the metallic construction of the shield and dual-entry blocks effectively eliminates interference between signal pins whether they are connected to ground or to a constant DC voltage source. As a result, the speed of machines employing such blocks can be increased with less signal disruption due to cross-talk between signals traveling through adjacent paths in the blocks.

SHIELD CONNECTOR BLOCK

Referring to FIGS. 2 and 3, the preferred embodiment of the shield connector block 26 constructed of 6061-T6 aluminum will now be described. The preferred shield connector block 26 has a length of 1.168 inches, width of 0.608 inches and height of 0.245 inches. In its preferred embodiment, the shield block 26 has a total of 115 holes formed therein. The holes 46 are arrayed in twenty-one columns spaced on 0.054 inch centers across the block 26 and eleven rows spaced on 0.052 inch centers as shown in FIG. 2. Each column contains either five or six holes 46, with the number of holes in a column alternating across the block 28. The holes 46 in each column are offset with respect to the holes in the adjacent column, also as shown in FIG. 2. Each row contains either ten or eleven holes 46, with the number of holes in a row alternating across the block 28. The holes 46 in each row are offset with respect to the holes in the adjacent row, also as shown in FIG. 2.

As shown in FIGS. 2 and 3, connector holes 46 may be either of a signal pin opening type 48 or a constant potential opening type 52, which is used to supply a ground or DC voltage connection between the various circuit boards. As best shown in FIG. 3, each of the signal pin openings 48 are formed by a conical recess 41 connected to a cylindrical bore 43 which defines a cavity in the connector block 26 enclosed by surface 45. The preferred embodiment has a conical recess 41 formed with a diameter of 0.054 inches narrowing down to a diameter of 0.028 inches, which is also the diameter of the cylindrical bore. The sidewalls of the conical recess are bevelled 30 degrees off of the longitudinal axis of the bore. Opposite the conical recess 41, the signal pin opening begins with a cylindrical bore 47 having a diameter of 0.040 inches and a depth of 0.010 inches from surface 50 of the block 26. That 0.040 inch bore is tapered down to a bore 51 with a diameter of 0.019 inches. The sidewalls of the tapered area are bevelled at an angle of 65 degrees off of the longitudinal axis of the signal pin opening. The 0.019 inch bore has a length of 0.008 inches and then widens out to the 0.028 inch bore 45 entering from the opposite side of the block 26. The walls of the area between the 0.028 inch and 0.019 inch bores are bevelled at an angle of 15 degrees off of the longitudinal axis. In the preferred embodiment, the signal pin openings 48 are formed in the block 26 before it is hardcoat anodized, which allows the anodizing to coat the interior surfaces of the signal pin openings 48 as well as the exterior surfaces.

After hardcoat anodizing, the constant potential openings 52 are formed in the block 26, which means that they are not coated with the hardcoat anodizing, as are the signal pin openings 48. The preferred openings 52, as best shown in FIG. 3, are formed by a conical recess 53 connected to a cylindrical bore 54 which defines a cavity in the connector block 26 enclosed by surface 55. The preferred embodiment has a conical recess 53 formed with a diameter of 0.052 inches narrowing down to a diameter of 0.025 inches, which is also the diameter of the cylindrical bore 54. The sidewalls of the conical recess are bevelled 30 degrees off of the longitudinal axis of the bore. Opposite the conical recess 53, the constant potential opening 52 begins with a cylindrical bore 56 having a diameter of 0.38 inches and a depth of 0.010 inches from the surface 50 of the block 26. The 0.040 inch bore 56 is tapered down to a bore 57 with a diameter of 0.017 inches. The sidewalls of the tapered area are bevelled at an angle of 65 degrees off of the longitudinal axis of the signal pin opening. The 0.019 inch bore has a length of 0.020 inches and then widens out to the 0.025 inch bore 54 entering from the opposite side of the block 26. The walls of the area between the 0.025 inch and 0.017 inch bores are bevelled at an angle of 59 degrees off of the longitudinal axis.

After the openings 52 are formed they are electrolytically plated to increase their conductivity. With the electrolytic plating, the openings 52 are adapted to contact outer surfaces of any ground or voltage connection pins 38 inserted therein. Thus, ground and voltage connection may be achieved between the various circuit boards 12. Only the constant potential openings 52 are plated, as the anodizing masks the remaining surfaces of the block 26 from plating. The preferred plating is comprised of zincate/copper/gold which provides suitable adhesion between the plated metals and aluminum of the preferred block. Other preferred platings can include a flash plated layer of nickel in place of the copper. Those skilled in the art will understand that a number of other metals and conductive coatings could also be substituted in place of those chosen in the preferred embodiment.

After plating, Zierick sockets 148 are placed in the constant potential openings 52 to provide releasable connections between the block 26 and pins 38 of the preferred embodiment while allowing the pins to make electrical contact to maintain the required potential within the half module. The sockets can be best seen in FIG. 3. The sockets 148 remain in place by friction and deformation of the plating inside the openings 52. The sockets 148 are sized to accept pins with a 0.012" diameter.

The dimensions for the block 26 and its associated openings have been given prior to anodizing or plating. Although the general construction of the constant potential openings 52 is similar to that of the signal pin openings 48, there are minor variations in the specific dimensions of the openings as discussed above. Those variations are attributable to the differences in the processing of the openings, as the anodized coating is thicker than the electrolytic plating and will tend to break down sharp corners. In the preferred embodiment, the anodizing has a preferred thickness of 2.0 mils prior to plating.

It will be appreciated by those skilled in the art that the exact number of holes, their spacing and the arrangement of the constant potential openings and signal pin openings in an of the blocks described above can be varied as required in each given application of this technology. Illustrations of the variety of patterns for the 95 and 115 hole blocks presently contemplated are seen in FIGS. 9–13, where holes 120 are constant potential openings and holes 122 are signal pin openings. Any pattern of constant potential openings could be used and the shape of the blocks could also be modified to suit the needs of any particular application.

DUAL ENTRY CONNECTOR BLOCK

Figure 6:
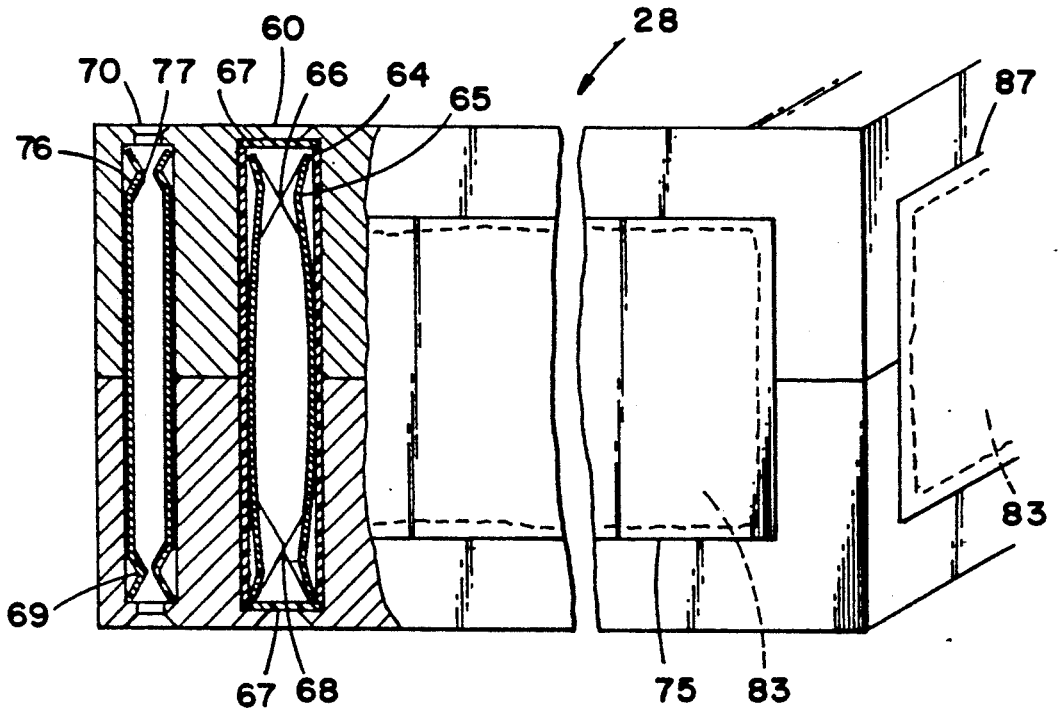
FIG. 6 is a cutaway perspective view, taken partially in cross-section of a dual entry connector block of the present invention.
Figure 7:
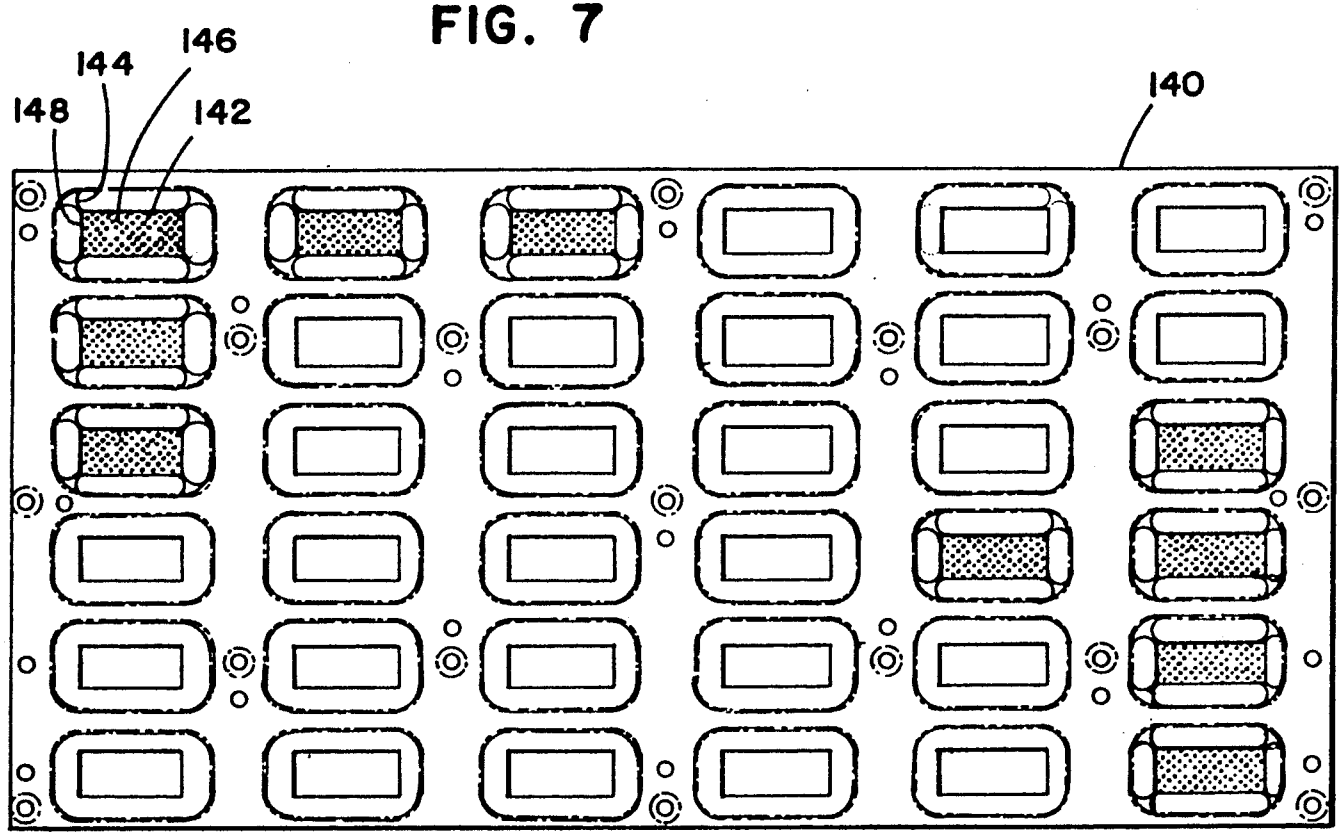
FIG. 7 is a top view of the sheet stock used in the preferred method of forming the connector blocks.

Referring to FIGS. 4–6, the preferred embodiment of the dual-entry connector block 28 will now be described. In its preferred embodiment, the dual-entry block 28 is comprised of two halves because the various elements located within the openings must be placed there prior to assembly of the block 28. The halves are essentially mirror images and, as such, only one half will be described in detail below.

Each half is preferably 1.168 inches long, 0.504 inches wide and 0.1965 inches high (thus forming a block 0.393 inches high when two halves are assembled). In its preferred embodiment, the dual-entry block 28 has a total of 95 holes formed therein. The holes 58 are arrayed in twenty-one columns spaced on 0.054 inch centers across the block 26 and nine rows spaced on 0.052 inch centers as shown in FIG. 4. Each column contains either four or five holes 58, with the number of holes in a column alternating across the block 28. The holes in each column are offset with respect to the holes in the adjacent column, also as shown in FIG. 4. Each row contains either ten or eleven holes, with the number of holes in a row alternating across the block 28. The holes in each row are offset with respect to the holes in the adjacent row, also as shown in FIG. 4.

As shown in FIGS. 4 and 5, the dual-entry connector holes 58 may be either of a signal pin opening type 60 or a constant potential opening type 70, which is used to supply a ground or DC voltage connection between the various circuit boards and/or half modules. The halves of the block 28 are mirror images and, therefore, only one half will be described in detail. As best shown in FIG. 5, each of the signal pin openings 60 are formed by a conical recess 61 connected to a cylindrical bore 62 which defines a cavity in the connector block 28 enclosed by a surface 63. The preferred embodiment has a conical recess formed with a diameter of 0.040 inches narrowing down to a diameter of 0.023 inches. The sidewalls of the conical recess are bevelled 30 degrees off of the longitudinal axis of the bore. The cylindrical bore 62 has a preferred diameter of 0.067 inches and is formed to a depth of 0.186 inches as measured from the contact surface 59. In the preferred embodiment, the signal pin openings 60 are formed in the block 28 before it is hardcoat anodized, which allows the anodizing to coat the interior surfaces of the signal pin openings, thus providing electrical insulation between the signal pins and body of the block 28.

In the preferred embodiment, the signal pin openings 60 each contain a non-conductive sleeve 64 with a preferred thickness of 0.012 inches and a non-conductive washer 67 at opposite ends with a preferred thickness of 5 mils which, in addition to preventing shorting of the signal pins, also aid in controlling the impedance of the signal pin openings 60 (in conjunction with the air space in the opening). The sleeve and washers are preferably comprised of a fluoropolymer, such as Teflon®, although other non-conductive materials could be substituted as will be recognized by those skilled in the art.

In the preferred embodiment, a contact element 65 is disposed within sleeve 64 and washers 67, and is formed of a resilient, electrically conductive material. Contact element 65 includes an inner surface having contact points 66 and 68 which are adapted to contact the outer surfaces of pins 38 when the pins are inserted into signal pin opening 60. Thus, electric signals may be transmitted from one pin to another when each pin is inserted into one end of the same signal pin opening 60. Contact points 66 and 68 hold pins 38 with different levels of force, with the preferred differential be 1:1.25. It is important that the elements 65 be inserted with the same orientation so that all higher force contact points 68 are on the same side of the block 28. The force differential allows the blocks 28 to be retained in connection with the pins 38 extending from one half module when the halves are separated for repair or maintenance. It will be appreciated by those skilled in the art that the contact element 65 could take many forms. In addition, no contact element could be provided with electrical contact being made between the pins or other conductive members themselves.

After hardcoat anodizing, the constant potential openings 70 are formed in the block 28, which means that they are not coated with the hardcoat anodizing, as are the signal pin openings 60. The preferred openings 70, as best shown in FIG. 5, are formed by a conical recess 71 connected to a cylindrical bore 72 which opens into a larger diameter bore which defines a cavity in the connector block 28 enclosed by surface 73. The conical recess 71 has a diameter of 0.038 inches narrowing to a smaller diameter of 0.023 inches. The sides of the recess are bevelled at an angle of 45 degrees off of the longitudinal axis of the cylindrical bore. The 0.023 inch bore 74 opens into a 0.0436 inch diameter bore. The 0.0436 inch bore is formed to a depth of 0.1815 inches from the contact surface 59 and the 0.023 inch bore 74 has a length of 0.002 inches.

After the openings 70 are formed they are electrolytically plated to increase their conductivity. The anodizing on the side surfaces 75 of the halves of the block 28, as well as the contact surfaces 59, is removed prior to the electrolytic plating, as the anodizing masks the remaining surfaces of the block 28 from plating. The anodizing on the contact surface 59, side surfaces 75 and end surfaces 87 is preferably removed by grinding. As a result, the constant potential openings 70, side surfaces 75, end surfaces 87 and the contact surfaces 59 are cleared of anodizing and plated. The preferred plating is comprised of zincate/copper/gold which provides suitable adhesion between the plated metals and metal of the block. Other preferred platings can include a flash plated layer of nickel in place of the copper. Those skilled in the art will understand that a number of other metals and conductive coatings could also be substituted in place of those chosen in the preferred embodiment.

A constant potential contact element 76 which is preferably made of an electrically conductive resilient material is disposed within the bore 72 defined by surface 73 and includes a pair of inner contact points 69 and 77 which are adapted to contact outer surfaces of any ground or voltage connection pins 38 inserted therein as well as being electrically connected to the plated bore. Contact points 69 and 77 hold pins 38 with different levels of force, with the preferred differential being 1:1.25. It is important that the elements 76 be inserted with the same orientation so that all higher force contact points 69 are on the same side of the block 28. The force differential allows the blocks 28 to be retained in connection with the pins 38 extending from one half module when the halves are separated for repair or maintenance. Thus, ground and voltage connection may be achieved between the various circuit boards 12. It will be appreciated by those skilled in the art that the contact element 76 could take many forms. In addition, no contact element could be provided with contact being made between the pins or other conductive members themselves, in conjunction with the plating and metal of the blocks 28.

The areas of the side surfaces 75 and end surfaces 87 which are electrolytically plated are preferably soldered after assembly to hold the halves of the block 28 together. The plating is necessary in those areas because solder 83 will not adhere to the anodizing coating the remainder of the block 28. Those skilled in the art will, however, recognize that many other methods and materials could be used to hold the assembled blocks 28 together including, but not limited to, adhesives and mechanical connectors.

The preferred dual-entry connector block 28 also includes extraction slots 79 located at both ends of each half of the block 28. The slots 79 allow precise manipulation of the halves when assembling the block 28 as well as allowing the fingers of an extraction tool to grasp and remove the block from the pins. In the preferred embodiment, each half contains four slots 79 at each end, the slots being spaced on 0.104 inch centers. Each slot is semicircular, with a diameter of 0.046 inches and is formed to a depth of 0.120 inches as measured from the outer surface of the block 28.

It will be appreciated by those skilled in the art that the exact number of holes, their spacing and the arrangement of the constant potential openings 70 and signal pin openings 60 can be varied as required in each given application of this technology. Illustrations of the variety of patterns for the 95 and 115 hole blocks presently contemplated are seen in FIGS. 9–13, where holes 120 are constant potential openings and holes 122 are signal pin openings.

METHOD OF MANUFACTURE

The preferred method of forming the shield blocks 26 and the halves of the dual-entry blocks 28 begins with milling a sheet of aluminum stock 140, preferably 6061-T6 aluminum, to form a number of blocks out of a 7"×14" sheet, as shown in FIG. 6. The preferred aluminum alloy is 6061-T6 because impurities in other grades of aluminum, particularly lead and cobalt, may cause electrolytic plating problems in later processing of the blocks. It will be understood by those skilled in the art that other metals could be substituted in place of aluminum, provided they are compatible with the other processes used to form the blocks and are, in addition, non-magnetic.

The blocks 142 remain attached to the sheet 140 at each corner 144 and the signal pin openings 146 are drilled in at that time. The blocks 142 are hardcoat anodized in sheet form after which the constant potential openings 148 are formed and the anodizing is removed from the side surfaces and contact surfaces of the dual-entry halves, as previously described. The blocks 142 are then individually removed from the sheet 140 and the corners are ground to remove any burrs. Care must be taken in removal to avoid deforming the blocks. The blocks are then ready to be electrolytically plated.

Although the method of forming the blocks 26 and 28 as described above teaches the milling of the blocks out of sheets of aluminum, those skilled in the art will recognize that other metals could be used in place of aluminum and, in addition, other methods of forming such as casting, injection molding or sintering could also be employed. The details for such processes will be known to those skilled in the art. Any alternative metals should be non-magnetic to avoid problems due to interaction between magnetic fields in the metal of the blocks and the electrical signals which will pass through the blocks.

In the preferred method of forming of the shield and dual-entry connector blocks, the electrolytic plating process must be modified to preserve the hardcoat anodizing on the blocks. The hardcoat anodizing is preferably 2.0 mils thick immediately following the anodizing process but is partially removed by chemicals used in standard plating processes. In the preferred method of coating described below approximately 1.0 mil of the anodizing is removed, leaving a finished coat of anodizing approximately 1.0 mil thick. It will be understood that a number of alternate materials could be used in place of the anodizing of the preferred embodiment.

The alternate materials must, however, adequately coat the blocks including the interior of the signal pin openings and resist the chemicals used in the plating process described below. Possible alternate materials include, but are not limited to, epoxy resins.

At this point the halves of the dual-entry connector blocks 28 undergo an additional processing step in which the anodizing is removed from the side surfaces 75, end surfaces 87 and contact surfaces 59. The preferred method of removing the anodizing is grinding, although other methods could be substituted.

The preferred plating process begins with washing the anodized blocks in an organic solvent, preferably methyl chloride, to remove surface impurities such as grease, oil, etc. The interior surfaces of the constant potential openings of both types of blocks along with the side surfaces, end surfaces and contact surfaces of dual-entry blocks are plated with zincate. The standard zincate plating process would immerse the blocks in a bath at a temperature of approximately 140 degrees Fahrenheit. To reduce the loss of anodizing, however, the preferred process holds the zincate bath at approximately 80 degrees Fahrenheit. The blocks are coated for approximately 30 seconds in an immersion zincate solution. After cleaning, the blocks are coated with a layer of copper by immersing them in a copper pyrophosphate bath (with a pH of 8.3 or less) held at 100 degrees Fahrenheit. The blocks are plated with copper for 10 minutes at 18 A.S.F. The blocks are cleaned again and then plated with gold. The gold plating process has a dwell time of 15 minutes at 5 A.S.F. in a normal bath temperature of 100 degrees Fahrenheit.

Those skilled in the art will recognize that other metals or a single metal could be substituted in place of the preferred zincate/copper/gold plating described above. In particular, palladium could be substituted for the gold portion of the preferred plating and flash plated nickel could also be substituted for the copper. As with the metal of the block, magnetic metals should be avoided because of problems with signal interference, although thin layers are allowable.

After the plating process is completed, the shield connector blocks 26 are removed from the sheet 140 and are then ready for use in the modules as described above. After removal from the sheet 140, the dual-entry connector blocks 28 must, however, be assembled with the non-conductive sleeves 64, non-conductive washers 67, and contact elements 65 and 76 disposed within the signal pin openings 60 and constant potential openings 70, respectively. Once the blocks 28 are assembled with their requisite parts, the halves are clamped and soldered together along the side surfaces 75 and end surfaces 87 which have been plated with the zincate/copper/gold plating. Those skilled in the art will, however, recognize that many other methods and materials could be used to hold the assembled dual-entry connector blocks 28 together including, but not limited to, adhesives, clamping devices, mechanical connectors, etc.

Figure 8:
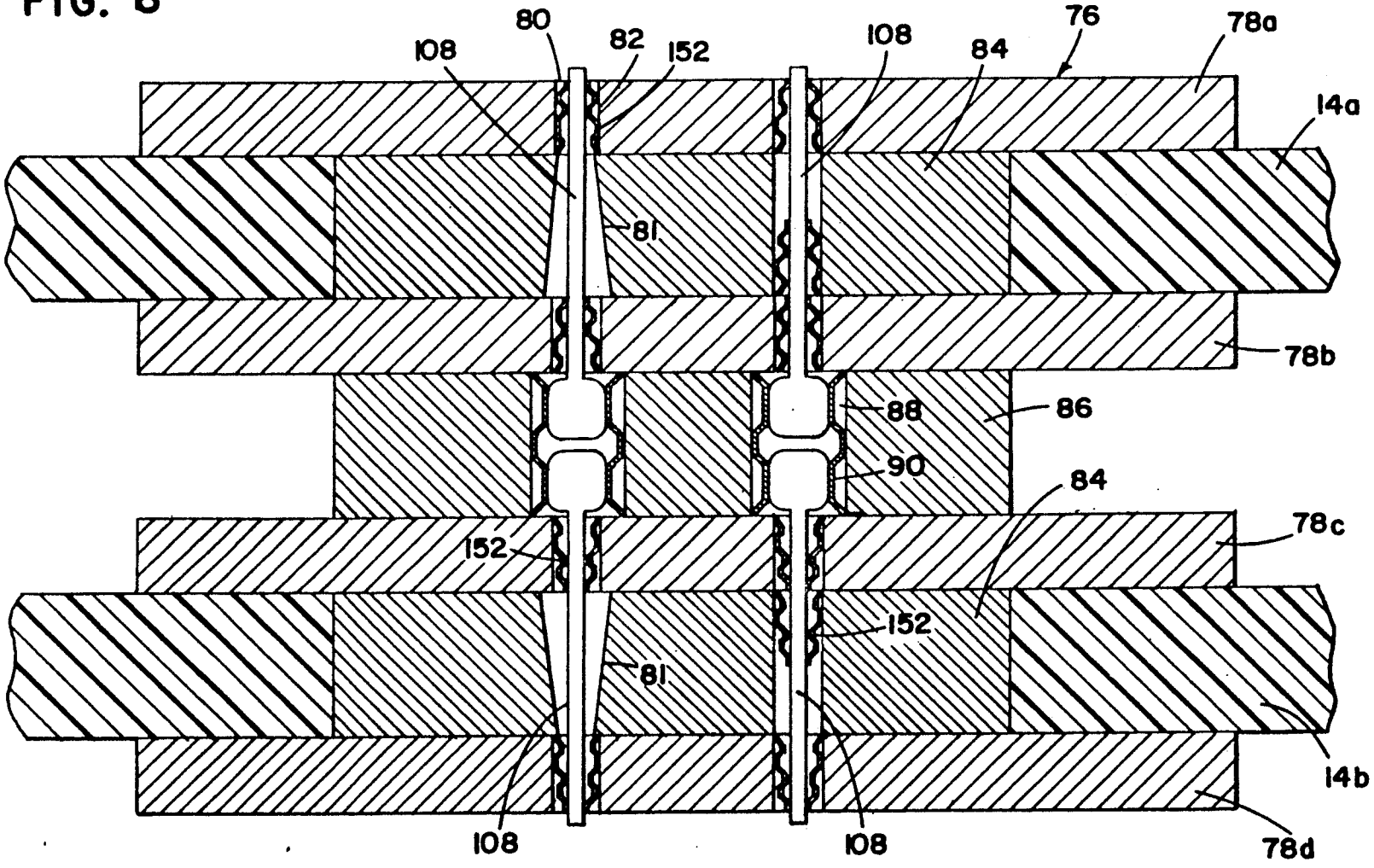
FIG. 8 is a side cutaway view of a second circuit board module using connector blocks of the present invention.
Figure 9:
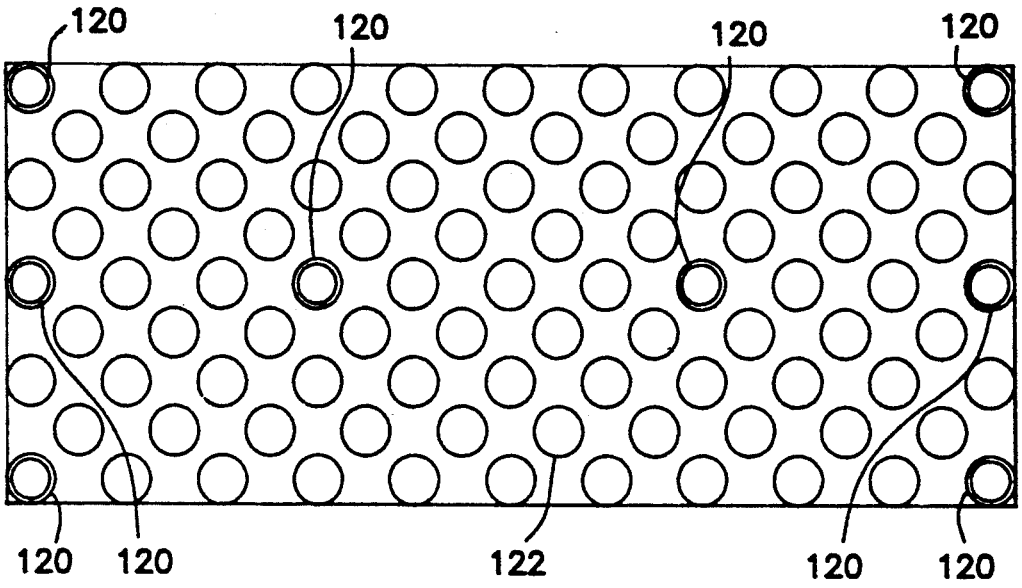
FIG. 9 is a top view of an alternate design of constant potential openings in a 95 hole block.
Figure 10:
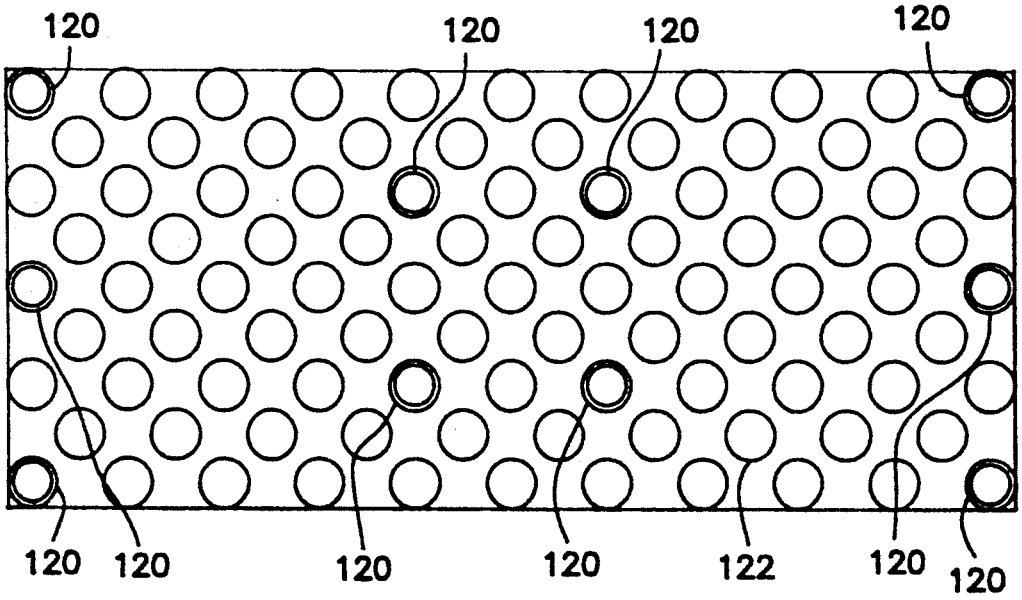
FIG. 10 is a top view of an alternate design of constant potential in a 95 hole block.
Figure 11:
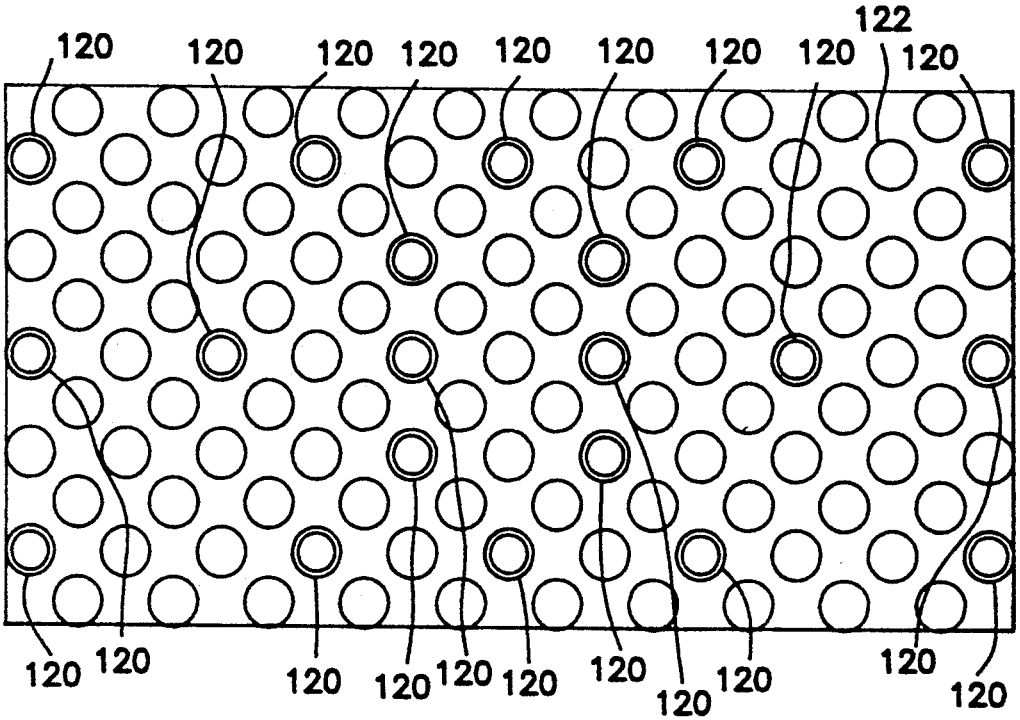
FIG. 11 is a top view of an alternate design of constant potential openings in a 115 hole block.
Figure 12:
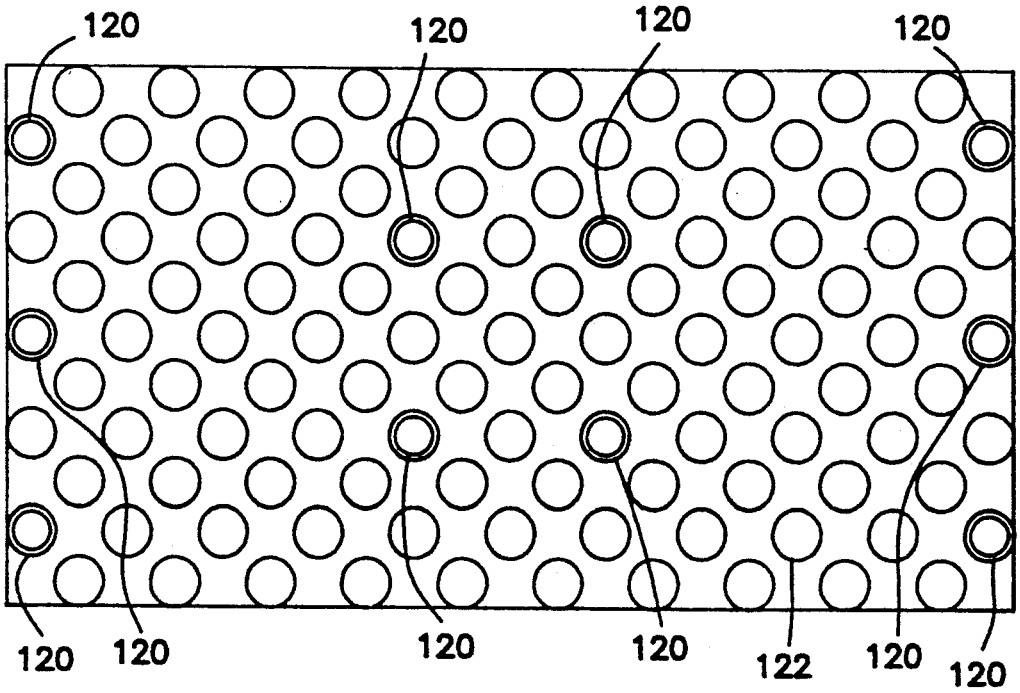
FIG. 12 is a top view of an alternate design of constant potential openings in a 115 hole block.
Figure 13:
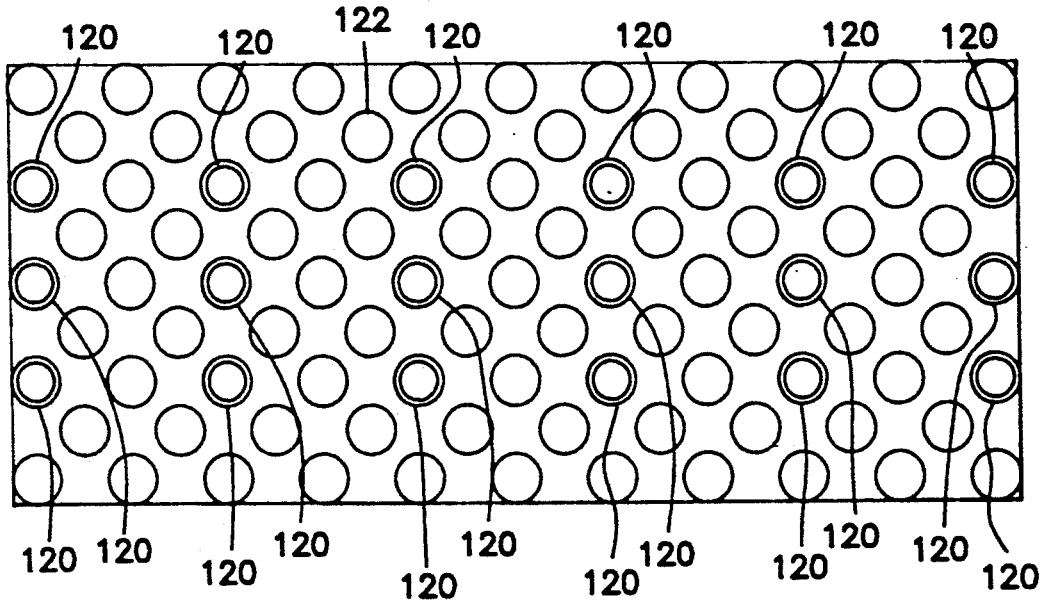
FIG. 13 is a top view of an alternate design of constant potential openings in a 95 hole block.

A second embodiment 76 of a circuit module interconnection assembly using the blocks of the present invention is schematically illustrated in FIG. 8. In this embodiment, circuit boards 78*a*, 78*b*, 78*c* and 78*d* (generally referred to as 78) are disposed in pairs about cold plates 14*a* and 14*b* (generally referred to as 14) in the same manner as in the earlier-described embodiment. This sandwich configuration comprises an upper half module and a lower half module electrically connected together, each half module comprising two circuit boards attached to opposite sides of a cooling plate. In this embodiment, each of the circuit boards 78 are provided with a plurality of signal pin receiving holes or recesses 80 having metallized surfaces 82 which are electrically connected to the circuitry on circuit board 78 as may be required. In addition, the preferred holes 80 also contain Zierick sockets 152 for releasable connection to pins 108.

Shield connector blocks 84 having a plurality of tapered pin alignment holes 81 as shown in FIG. 8 (only a few shown for clarity) are disposed within an opening defined in cold plate 14, in a similar manner as in the above-described embodiment. Resilient pins 108 are inserted through recesses 80 from, for example, circuit board 78*b* through tapered holes 81 of shield connector block 84 which self-aligns pins 108 into recesses 80 of circuit board 78*a*. Likewise, pins 108 are also inserted through recesses 80 from circuit board 78*c* through tapered holes of shield connector block 84 which self-aligns pins 108 into recesses 80 of circuit board 78*d*. As in the preferred embodiment of the shield connector blocks 26 above, the constant potential openings of these shield connector blocks 84 also preferably contain Zierick sockets 152 or an equivalent connection means.

A dual-entry connector block 86 is provided between the half modules for electrical communication therebetween, and has an array of connector through-holes 88 defined therein, each having a means of conducting current between the pins of the upper and lower half modules. This means may take the form of dual-entry contacts 90 such as the type described above in conjunction with connector block 28 of FIG. 3. In the alternative, when the pins are used to conduct current between the modules the pins may contact each other within holes in connector block 86.

The construction of the alternative blocks described above is essentially the same as for the first preferred embodiments described above, with changes to incorporate the tapered holes to aid in the use of the self-aligning pins described above. For a more complete discussion of the types of pins and other arrangements and details of modular construction as described above, reference can be had to U.S. Pat. No. 4,939,624 issued on Jul. 3, 1990 to August et al., which is hereby incorporated by reference.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

We claim:

1. A method of forming a completely shielded connector block apparatus for use in connecting at least two circuit boards via electrically conductive members, comprising the steps of:

a) forming a one-piece, completely integral metallic body having two substantially parallel exterior faces connected by at least one side surface;

b) forming at least one signal opening through the exterior faces of said body adapted to receive at least one electrically conductive member, each of said signal openings having an interior surface which is electrically insulated from the metal of said body;

c) coating the exterior faces of said body, side surface of said body and the interior surface of each of said signal openings with an electrically insulative coating; and d) forming at least one electrically conductive constant potential opening through the exterior faces of said body adapted to receive at least one electrically conductive member, each of said constant potential openings in electrical communication with the metal of said body.

2. The method of claim 1, wherein the metal of said body is substantially comprised of aluminum.

3. The method of claim 1, wherein the step a) of forming said body comprises casting the body of a metallic material.

4. The method of claim 1, wherein the step a) of forming said body comprises milling said body.

5. The method of claim 2, wherein the step c) of coating comprises anodizing said body.

6. The method of claim 1, further comprising a step:

e) of coating the interior surface of each of said constant potential openings with an electrically conductive coating.

7. The method of claim 6, further comprising, prior to step e), the step of removing said electrically insulative coating from the contact surfaces of said upper and lower sections, thereby coating the contact surfaces with the electrically conductive coating of step e).

8. The method of claim 6, wherein step e) further comprises electrolytically coating a first layer of zincate, second layer of copper and a third layer of gold.

9. A method of forming a completely shielded connector block apparatus for use in connecting at lest two circuit boards via electrically conductive members, comprising the steps of:

a) forming a metallic body having two substantially parallel exterior faces connected by at least one side surface;

b) forming at least one signal opening through the exterior faces of said body adapted to receive at least one electrically conductive member, each of said signal openings having an interior surface which is electrically insulated from the metal of said body;

c) coating the exterior faces of said body, side surface of said body and the interior surface of each of said signal openings with an electrically insulative coating;

d) forming at least one electrically conductive constant potential opening through the exterior faces of said body adapted to receive at least one electrically conductive member, each of said constant potential openings in electrical communication with the metal of said body; and e) placing an insulating sleeve in each of said signal openings to control the electrical impedance of said signal openings.

10. The method of claim 9, wherein said step of forming said body further comprises the steps of forming said body in upper and lower sections, with each of said sections having one of said two exterior faces, at least a portion of said side surface, and a contact surface, such that the contact surfaces of the upper and lower sections contact each other when said body is assembled and further comprising the final step of joining the upper and lower sections to form said connector block.

11. The method of claim 10, wherein the step of joining said upper and lower sections comprises:

removing said electrically insulative coating from at least a portion of the side surfaces of each section, coating said portions with said electrically conductive coating, and applying solder to said portions, whereby a soldered joint is formed between said upper and lower sections.

12. The method of claim 9, further comprising the step of placing at least one ground contact element in each of said constant potential openings, each of said ground contact elements making electrical connection between electrically conductive members inserted into said constant potential openings and said metallic body.

13. The method of claim 9, further comprising the step of placing at least one signal contact element within each of said insulating sleeves, each of said signal contact elements releasably receiving electrically conductive members inserted into opposing ends of said signal openings.

14. The method of claim 9, further comprising the step of providing said insulating sleeves of a fluorpolymer material.

15. The method of claim 9, wherein said step of coating said exterior faces of said body comprises anodizing.

16. The method of claim 9, further comprising the step of coating the interior surface of each of said constant potential openings with an electrically conductive coating.

17. The method of claim 16, wherein the step of coating the interior surface of each of said constant potential openings further comprises electrolytically coating a first layer of zincate, second layer of copper and a third layer of gold.

* * * * *

UNITED STATES PATENT AND TRADEMARK OFFICE

CERTIFICATE OF CORRECTION

PATENT NO. : 5,224,918

DATED : July 6, 1993

INVENTOR(S) : Eugene C. Neumann et al.

It is certified that error appears in the above-identified patent and that said Letters Patent is hereby corrected as shown below:

In [62], insert --issued Jan. 12, 1993-- after the numeral "5,178,549" therefore.

In column 6, line 57, "0.38" should read --0.038-- therefore.

In column 7, line 43, "an" should read --and-- therefore.

In column 8, line 50, "electric" should read --electrical-- therefore.

In column 8, line 54, "be" should read --being-- therefore.

In column 14, line 35 (claim 13), "lest" should be --least-- therefore.

In column 14, lines 39 and 40 (claim 14), "fluorpolymer" should be --fluoropolymer-- therefore.

Signed and Sealed this

Twenty-second Day of March, 1994

*Attest:*

Bruce Lehman

BRUCE LEHMAN

*Attesting Officer*

*Commissioner of Patents and Trademarks*